United States Patent [19]

Mabie

[11] 4,264,123

[45] Apr. 28, 1981

[54] GUN TELESCOPE EXTENDER

[76] Inventor: Norman Mabie, 121 Broad St., Claremont, N.H. 03743

[21] Appl. No.: 39,101

[22] Filed: May 15, 1979

[51] Int. Cl.[3] ..... G02B 23/16

[52] U.S. Cl. ..... 350/57

[58] Field of Search ..... 350/57; 33/244

[56] References Cited

U.S. PATENT DOCUMENTS

| | | | |
|---|---|---|---|
| 737,872 | 9/1903 | Saegmuller | 350/57 |
| 1,943,387 | 1/1934 | Jung | 350/57 |
| 2,271,380 | 1/1942 | Strang | 350/57 |
| 3,183,594 | 5/1965 | Panunzi | 350/57 |
| 3,315,362 | 4/1967 | Palmer | 350/57 |
| 3,390,931 | 7/1968 | Luning et al. | 350/57 |
| 3,594,061 | 7/1971 | Selvage | 350/57 |
| 3,594,062 | 7/1971 | Disley | 350/57 |
| 3,669,523 | 6/1972 | Edwards | 350/57 |

FOREIGN PATENT DOCUMENTS

| | | | |
|---|---|---|---|
| 16543 | of 1914 | United Kingdom | 350/57 |

*Primary Examiner*—Jon W. Henry

*Attorney, Agent, or Firm*—Pearson & Pearson

[57] ABSTRACT

A gun telescope extender is an elongated tube with an unobstructed axial bore of uniform diameter and about six bellows folds between its eye end and its scope end. The scope end of the tube includes outward projecting, integral, pull tabs for removing the extender from the telescopic lens. The eye end of the tube is pre-formed with an oblique and slightly concave rim to fit the eye and seal it from light. The eye end is free of outward flare. The bellows compress evenly, without tilt or undue resistance when in use.

7 Claims, 6 Drawing Figures

GUN TELESCOPE EXTENDER

BACKGROUND OF THE INVENTION

It has heretofore been proposed to provide a shallow cup of flexible material on the eye end of an eyepiece of a gunsight or optical instrument as exemplified in U.S. Pat. No. 737,872 to Saegmuller of Sept. 1, 1903. Similar, truncated conical, short length eye shields are disclosed in U.S. Pat. No. 2,271,380 to Strang of Jan. 27, 1942, U.S. Pat. No. 3,594,061 to Selvage of July 20, 1971, U.S. Pat. No. 3,669,523 to Edwards of June 13, 1972, and U.S. Pat. No. 3,594,062 to Disley of July 20, 1971.

A light protector of coil spring structure and of substantial length is disclosed in U.S. Pat. No. 1,943,387 to Jung of Jan. 16, 1934 and similar relatively elongated, generally cylinderical eye protectors for telescopic sights are disclosed in U.S. Pat. No. 3,183,594 to Panunzi of May 18, 1965 and U.S. Pat. No. 3,390,931 to Luning of July 2, 1968.

SUMMARY OF THE INVENTION

None of the above patents, however, teach an elongated, gun telescope extender having a generally cylindrical, hollow, tubular body with about six bellows folds in the central portion, an unobstructed axial bore of uniform, minimum inside diameter except at the outward projecting folds of the bellows, an unflared rim at the eye and obliqued and concaved to fit tightly against the face and a pair of outwardly projecting, integral pull tabs at the scope end. The eye shield of this invention compresses evenly without sidewise tilt, can be slipped on and off the end of the sight with ease and the soft, face-conforming, obliqued, and somewhat elliptical, outer end shuts out all light interference while the tube fills the "eye relief" gap without danger of impact to the eye.

DESCRIPTION OF A PREFERRED EMBODIMENT

Figure 1:
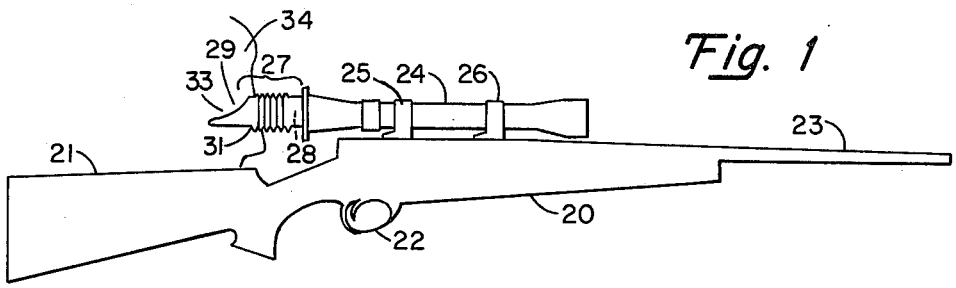
FIG. 1 is a side elevation of a typical shoulder type gun with a typical telescopic sight mounted thereon and with the telescope extender of the invention removably affixed thereon
Figure 2:
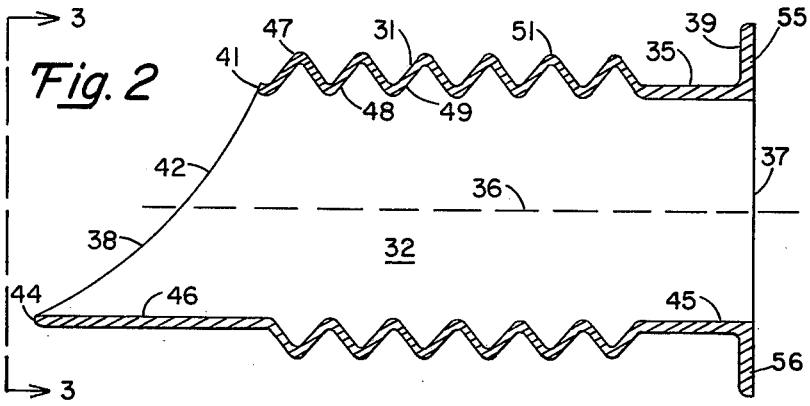
FIG. 2 is an enlarged, side elevation in half section of the extender shown in FIG. 1
Figure 3:
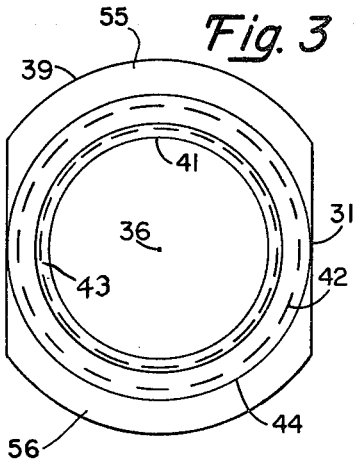
FIG. 3 is an end view on line 3—3 of the extender shown in FIG. 2

A typical shoulder type gun 20 is shown in FIG. 1 with a butt 21, trigger 22, barrel 23 and a telescopic sight 24 non-yieldably affixed by brackets, or clamps, 25 and 26. Conventionally there is an "eye relief" gap 27, about three to four inches in length between the cylindrical eyepiece 28 of the scope 24 and the eye 29 of the user.

As shown small scale in FIG. 1 the gun sight extender 31 of the invention is preferably about four and one half inches in length to fill the "eye relief gap" 27 and of soft rubber like material 32 so that, when the gun kicks, there will be no harmful impact on the area 33 of the face 34 in the vicinity of the eye 29. The extender 31 thus comprises an elongated, hollow, tubular body 35 with an axial bore having a substantially uniform inside diameter of about one and one half inches, a central, longitudinal axis designated 36, an open forward end 37 and an open rearward end 38.

An integral flange 39 projects outwardly from the forward portion of body 35, preferably in a plane normal to the central longitudinal axis 36, and preferably projecting for a distance of about one quarter of an inch to serve as a pull tab or finger grip when the forward open end 37 is slid onto the cylindrical eyepiece 28 for frictional attachment but easy removal.

The peripheral rim 41 around the opposite open rearward end of body 35 extends in a plane obliqued to the central longitudinal axis 36 at an angle between 40° to 50° and preferably at 45° as shown. In addition to its obliquity, the rim 41 defines a concavity 42 and 43 each centrally of an opposite side of the rim which is the arc of a circle of about 3.2 inches in radius and creates a compound, somewhat elliptical curved end which closely conforms to the configuration of the face in the area of the eye. Preferably the lower tip 44 at the rearward extremity of rim 42 is turned to about 20° to 30° from the vertical to better fit the eye area.

The preferred embodiment 31 of the extender of the invention while of substantially uniform mimimum diameter and cylinderical at the forward end 45 and at the rearward end 46 includes a series of outward projecting bellows such as at 47, 48, 49, and 51, the inner portions of which are equal in inside diameter to the inside diameter of the end portions, so that the axial bore is unobstructed.

The preferred embodiment 31 is thus characterized by an unobstructed axial bore of uniform, minimum diameter from one end to the other. Also by a pair of opposite pull tabs 55 and 56, each projecting about one quarter of an inch from the forward, or scope end 37 and forming the flange 39. The rearward, or eye, end 38 is preformed with its eye fitting obliquity and concavity but is not outwardly flared and retains its cylindrical configuration. The eye relief gap 27 is filled by the axially directed compression of the bellows to the amount needed without requiring to be tilted and unevenly compressed.

Figure 4:
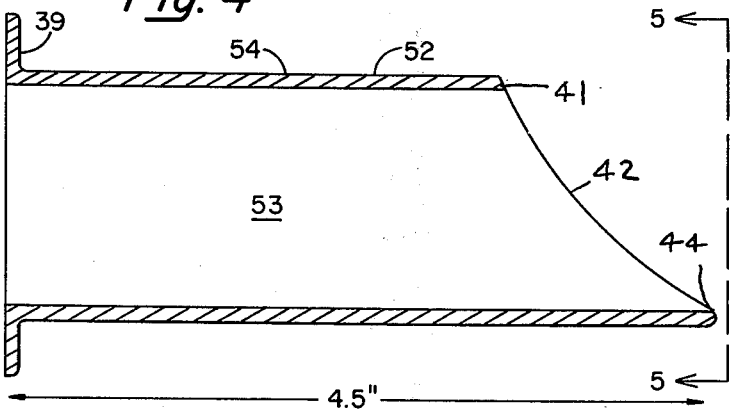
FIG. 4 is a view similar to FIG. 2 of another embodiment of the invention
Figure 5:
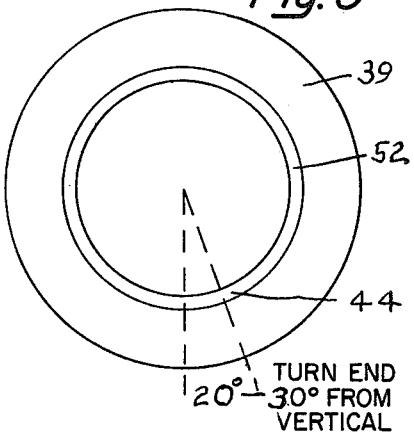
FIG. 5 is an end view on line 5—5 of the extender shown in FIG. 4
Figure 6:
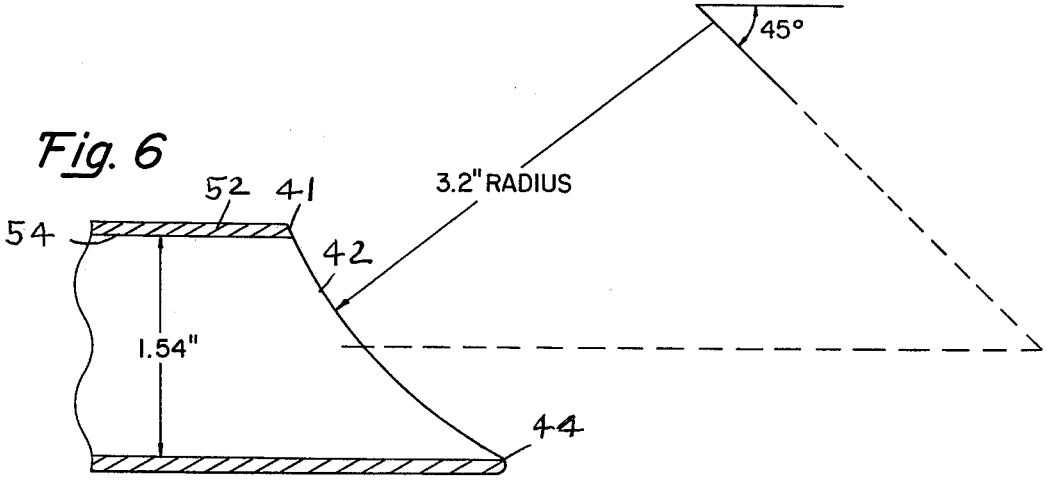
FIG. 6 is a fragmentary side elevation of the curved, obliqued, rim of the extender of the invention showing the preferred radii thereof for a typical extender.

The embodiment 52 shown in FIGS. 4 and 5 is identical with the preferred embodiment except that the rubber 53 of the cylindrical body 54 is of a softer durometer and the intermediate bellows portion is not used.

In FIG. 5 the open rearward end of the extender of the invention is shown fragmentarily with the radii of the arcuate concavity shown in dotted lines.

I claim

1. A gun telescope extender for use in hunting in dusk or dawn when visibility is marginal, said extender comprising:

an elongated, hollow tubular body of soft rubber-like material said body having a central longitudinal axis and a substantially uniform minimum inside diameter forming an unobstructed axial bore;

a hollow cylindrical rim with a pair of opposite outwardly projecting integral pull tabs at one open end of said body, said pull tabs extending in a plane normal to the said axis and said open end being of predetermined dimensions for slidably and frictionally fitting over the eyepiece end of a telescopic lens; and a hollow peripheral unflared, rim at the opposite open end of said body, said rim outlining a cylinder and extending in a plane oblique to said axis at an angle of between 40° to 50° and defining a concavity centrally of each opposite side thereof, to conform to the configuration of the area of a human face adjacent the eye.

2. A gun telescope extender as specified in claim 1 wherein:

said hollow peripheral rim at the opposite end of said body extends in a plane obliqued to said axis at an angle of about 45°.

3. A gun telescope extender as specified in claim 1 wherein:

said hollow peripheral rim at the opposite end of said body extends in a plane oblique to said axis at an angle of about 45°; and said rim is concaved at each opposite side of said rim to define an arc of a circle of about 3.2 inches in radius.

4. A gun telescope extender as specified in claim 1 wherein:

said tubular body includes a plurality of integral bellows enlargements intermediate of the length thereof each extending outwardly away from said unobstructed axial bore.

5. A gun telescope extender as specified in claim 1 wherein:

said hollow tubular body is at least four inches in length, of uniform inside diameter at said one open end and said pair of pull tabs each project at least about one quarter inch from said body for easy removal and installation of said extender.

6. A gun telescope extender for use in hunting at dusk or dawn when visibility is marginal said extender comprising:

an elongated generally cylindrical tubular body of rubber like material having a central longitudinal axis opposite open ends, and an unobstructed axial bore;

a pair of integral, outwardly projecting pull tabs at one open end of said body serving as a finger grip, for slidable, frictional mounting of said extender on the eyepiece end of a telescopic lens;

a plurality of outward projecting bellows folds in said elongated body, intermediate of said ends;

and a peripheral rim at the other open end of said body extending in a plane at about forty five degrees to said axis and concave curved to conform to the configuration of a human face in the area of the eye.

7. An extender as specified in claim 6 wherein:

said body is at least four inches in length and about one and one half inches in diameter and each said pull tab projects at least one quarter inch from said body.

* * * * *